United States Patent [19]

Olsen et al.

[11] Patent Number: 5,044,548

[45] Date of Patent: Sep. 3, 1991

[54] STACKING BALL CARTON, BLANK AND METHOD

[75] Inventors: Leo T. Olsen, 93 W. Fullerton, Glendale Heights, Ill. 60139; Thomas W. Fester, Woodridge, Ill.

[73] Assignee: Leo T. Olsen, White Heath, Ill.

[21] Appl. No.: 414,093

[22] Filed: Sep. 28, 1989

[51] Int. Cl.[5] ..... B65D 5/48

[52] U.S. Cl. ..... 229/120.03; 229/120.18

[58] Field of Search ..... 229/120.03, 120.18; 206/315.9, 614, 621

[56] References Cited

U.S. PATENT DOCUMENTS

| | | | |
|---|---|---|---|
| 1,983,499 | 12/1934 | Rosenthal | 206/315.9 |
| 2,888,185 | 5/1959 | Porter | 229/120.18 |
| 3,326,444 | 6/1967 | Farquhar et al. | 229/120.18 |
| 3,563,449 | 2/1971 | Forbes, Jr. | 229/120.18 |
| 3,869,062 | 3/1975 | Jaeschke et al. | 229/120.18 |
| 4,219,148 | 8/1980 | Garmon | 229/120.18 |
| 4,482,055 | 11/1984 | Boyle | 229/120.18 |
| 4,541,560 | 9/1985 | Fischer | 229/120.18 |
| 4,848,563 | 7/1989 | Robbins | 206/315.9 |
| 4,919,261 | 4/1990 | Lashyro et al. | 229/120.18 |

FOREIGN PATENT DOCUMENTS

| | | | |
|---|---|---|---|
| 753118 | 2/1967 | Canada | 229/120.03 |

*Primary Examiner*—Gary E. Elkins
*Attorney, Agent, or Firm*—Jack E. Dominik

[57] ABSTRACT

A stacking carton for a plurality of spherical or nesting products in which the carton comprises four tubular internal sections, four wall members or tube sides, and opposed closed ends is disclosed. The tubular sections are defined by two anchored full panel struts having anchor tabs for being secured interiorly of the tube sides, and two partial panel struts having a secured portion and an unsecured portion positioned in spaced relationship each to the other, the space being such that the contained articles such as a gold ball cannot pass through the space, and anchor tabs for the secured portions which are secured to the interior portions of their respective sides. The blank of the present invention is designed for a folding carton which has a tubular body and with four internal sections. The blank is characterized by four adjacent tube side panels, two of which are center panels and meet at an adjacent fold line, and two of which are remote panels which extend laterally from the respective center panels. At the remote ends anchors secure the struts of the partial strut panel member and glue flaps at the far ends of the carton secure the full strut to the respective central tube sides header portions. The bottom and top forming members extend from opposite sides of the tube sides.

4 Claims, 8 Drawing Sheets

STACKING BALL CARTON, BLANK AND METHOD

FIELD OF THE INVENTION

The present invention relates to the general field of folding cartons which are shipped knocked down and then erected at some time prior to use. While the invention is directed primarily to a stacking golf ball carton, it will be appreciated that the same can be utilized effectively for ping pong balls, tennis balls, baseballs, as well as nesting items such as shuttle cocks for badminton, and a whole host of products which lend themselves to stacking.

SUMMARY OF THE PRIOR ART

The prior art is illustrated generally in FIGS. 1, 2 and 3 of the accompanying drawings. Basically the display assembly 1 as best seen in FIG. 1 comprises a bottom box portion 2 and a box lid portion 3. As shown, four ball stack holders 4 are proportioned to fit interiorly of the bottom box portion 2, and thereafter the unit 15 assembled by placing the box lid portion 3 over the bottom box portion 2. Specifically as shown, two of the stack holders 4 have been removed and two remain in the bottom box portion 2. As shown in FIG. 2, the bottom box portion blank 5 and the box lid portion blank 6 are placed with the bottom 5 above the top 6. In FIG. 3, the ball stack holder blanks 7 are shown. Golf balls are shown in partial phantom lines and partial solid lines as golf balls 8 in FIG. 1. Such a display assembly 1 as just described consumes a significant amount of paper board. This is illustrated most dramatically in FIG. 2 where the display assembly carton blank 20 of the present invention is shown placed to the left of the carton blanks which form the bottom box portion 2 and the box lid portion 3, namely bottom box portion blank 5 and box lid portion blank 6. By comparison, it becomes apparent that utilizing the stacking golf ball assembly carton 20 of the present invention uses the same or a lesser amount of board than just the bottom box portion 2 and the box lid portion 3 of the display assembly 1 of the prior art. The board which is saved, is that which is illustrated in FIG. 3 which are the four blanks which make up the four ball stack holders.

SUMMARY OF THE INVENTION

The present invention is directed to a stacking carton for a plurality of spherical or nesting products in which the carton comprises four tubular internal sections, four wall members or tube sides, and opposed closed ends. The tubular sections are defined by two anchored full panel struts having anchor tabs for being secured interiorly of the tube sides, and two partial panel struts having a secured portion and an unsecured portion positioned in spaced relationship each to the other, the space being such that the contained articles such as a golf ball cannot pass through the space, and anchor tabs for the secured portions which are secured to the interior portions of their respective sides.

The carton blank of the present invention is designed for a folding carton which has a tubular body and with four internal tubular sections. The blank is characterized by four adjacent tube side panels, two of which are center panels and meet at an adjacent fold line, and two of which are remote panels which extend laterally from the respective center panels. At the remote ends anchors secure the struts of the partial strut panel member and glue flaps at the far ends of the carton secure the full strut to the respective central tube sides header portions. The bottom and top forming members extend from opposite sides of the tube sides.

In the method of forming the stacking ball carton, the two remote glue flaps at the very opposite ends of the carton blank have glue applied, and thereafter they are anchored to the adjacent tube side centers by folding at the respective fold lines between the partial strut anchor on opposite sides with the glue flaps being secured to the adjacent tube side central panels. The final glue application is made with an automatic adhesive applicator such as a Mactron applied optionally to the remote fold line presented after the anchored full struts have been secured to the tube side centers. Thereafter, the panel is folded again along the central fold line which divides the two tube side center panels, and upon curing, the carton is completed. It will be noted that the windows are optionally provided, which can be covered with a transparent material or left uncovered.

A sleeve cover comprising four stacking lids, each having opening tabs, is secured in place by a top cover, or in an alternative embodiment, by hot melt glue application of the lateral sleeve cover liner flaps to the exterior portion of the adjacent tube panel.

In view of the foregoing, it is a primary object of the present invention to provide a single folding carton for stacking products such as golf balls, ping pong balls, badminton, shuttle cocks, and the like which utilizes approximately half as much material as the prior art.

A further object of the present invention is to provide a stacking carton which can be quickly erected by hand and filled by hand, and yet is also adaptable for automated filling.

Yet another object of the present invention is to provide a stacking carton in which the contained product contributes to the stability and structural integrity of the completed carton.

BRIEF DESCRIPTION OF THE DRAWINGS

Further objects and advantages of the present invention will become apparent as the following description proceeds, taken in conjunction with the accompanying illustrative drawings, in which.

DESCRIPTION OF PREFERRED EMBODIMENTS

Figure 1:
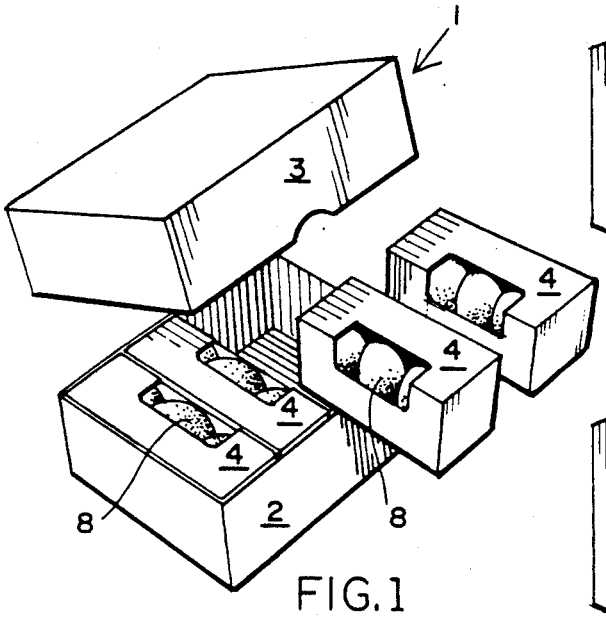
FIG. 1 PRIOR ART
FIG. 1 is a perspective view of a display assembly illustrative of the prior art showing a bottom, a lid, and four ball stack carton holders.
Figure 3:
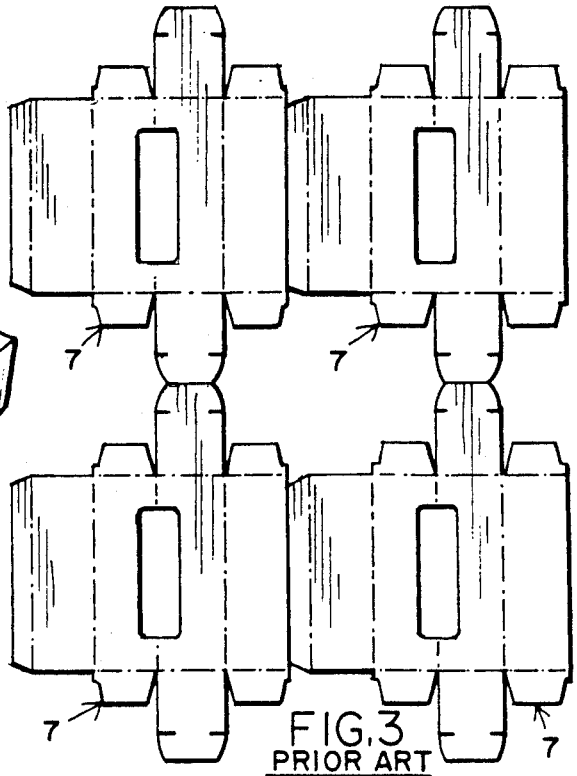
FIG. 3 PRIOR ART
FIG. 3 shows four ball stack holder blanks essentially in scale with those of FIG. 2 illustrating the amount of material which is totally saved from the construction of the stacking ball carton of the present invention.
Figure 2:
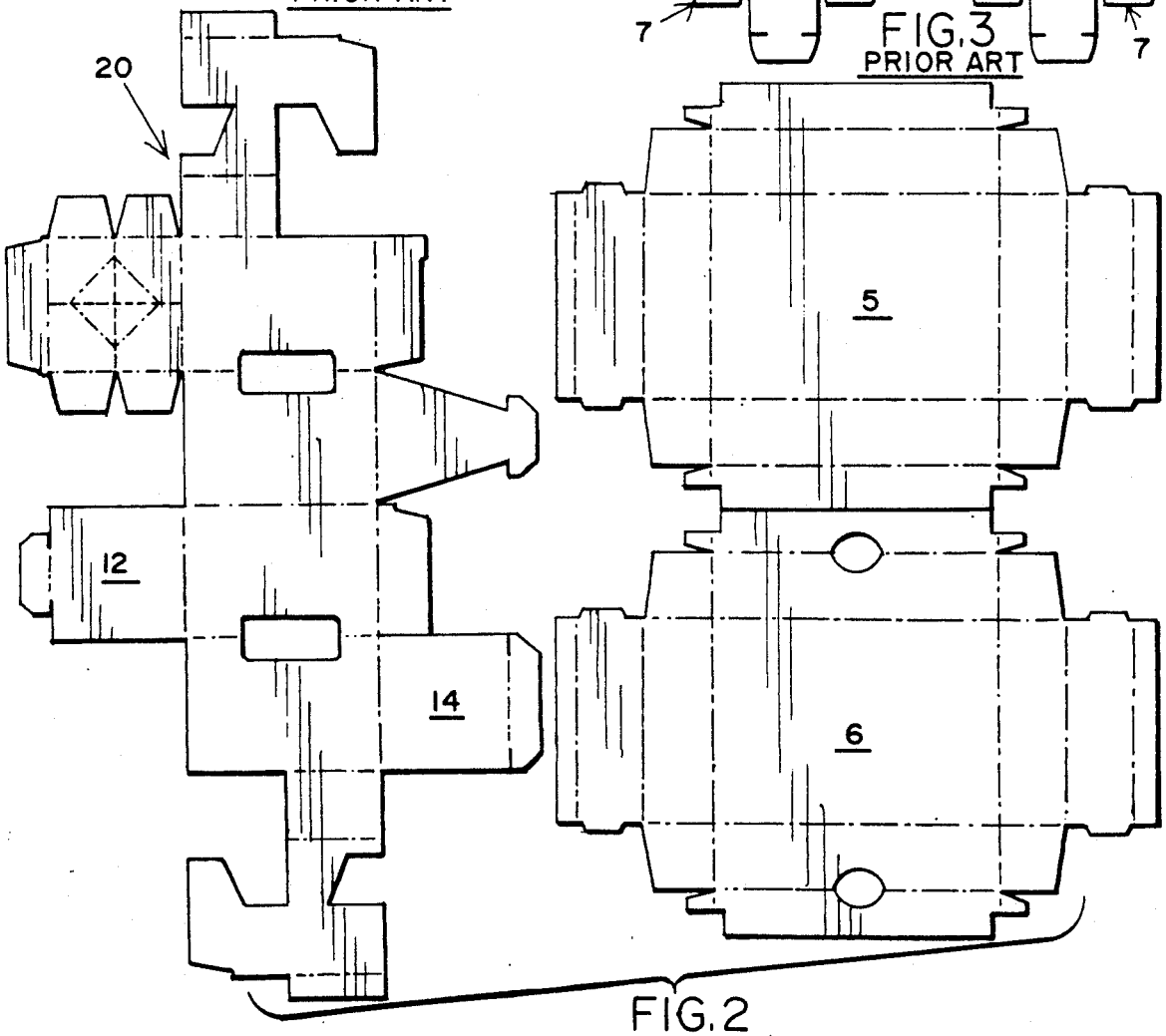
FIG. 2 is a layout of the bottom box portion blank and box lid portion blank as shown in FIG. 1 with side-by-side comparison of the stacking ball carton blank of the present invention illustrating the relative amount of material employed in order to make the carton illustrative of the present invention as compared with the prior art display assembly of FIG. 1.

The prior-art display assembly 1 as shown in FIG. 1 has already been described as one having a bottom box portion 2 and a box lid portion 3 and containing four ball stack holders 4. As seen in FIG. 2, just the bottom box portion blank 5 and the box lid portion blank 6 provide almost enough board to make the entire stacking golf ball carton blank of the present invention. Shown in FIG. 3, of course, are the four ball stack holder blanks 7 of the prior art. The golf balls 8 are contained as shown in FIG. 1.

Figure 13:
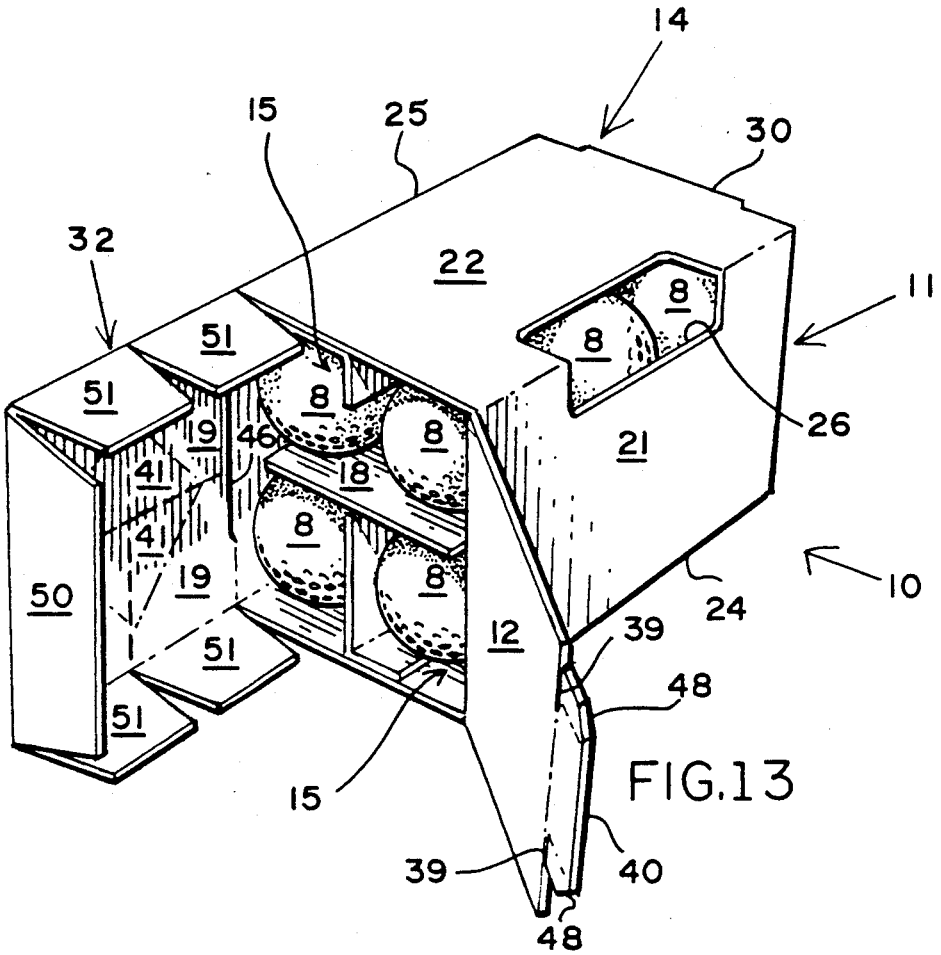
FIG. 13 is a view sequential to that of FIG. 12 showing the golf balls all loaded in the carton ready for closing the top.

Turning now to FIG. 13, the stacking golf ball carton 10 illustrative of the present invention is shown as having a tubular body 11. A top 12 is at one end and a bottom 14 is at the opposed end. The bottom 14 can be of a wide variety of construction, the one being shown here as a closure, and a bottom lock having a tab. In FIG. 13 the stacking ball carton 10 is shown partially opened and illustrating the internal tubular sections 15, and a plurality of golf balls 8 which are contained in the internal tubular section 15.

Figure 5:
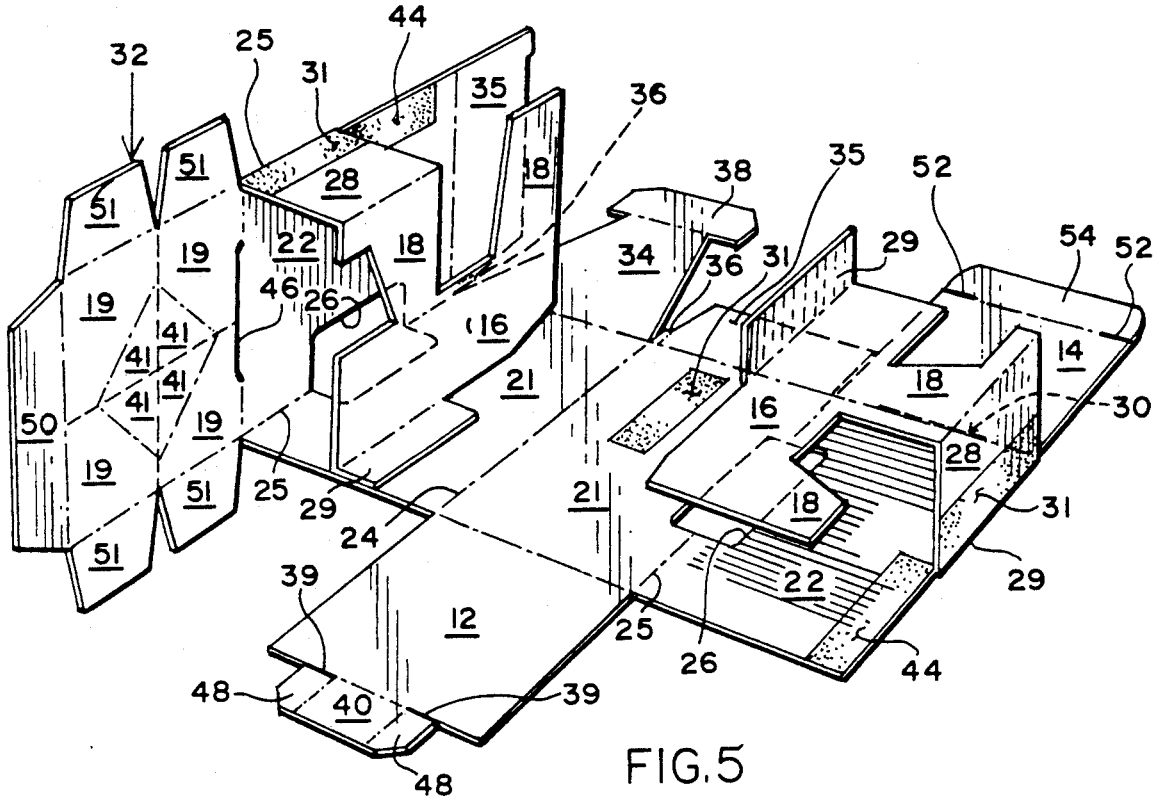
FIG. 5 is the beginning of a sequence of perspective view FIGURES showing how the carton blank is sequentially formed into the golf ball carton illustrative of the present invention.
Figure 16:
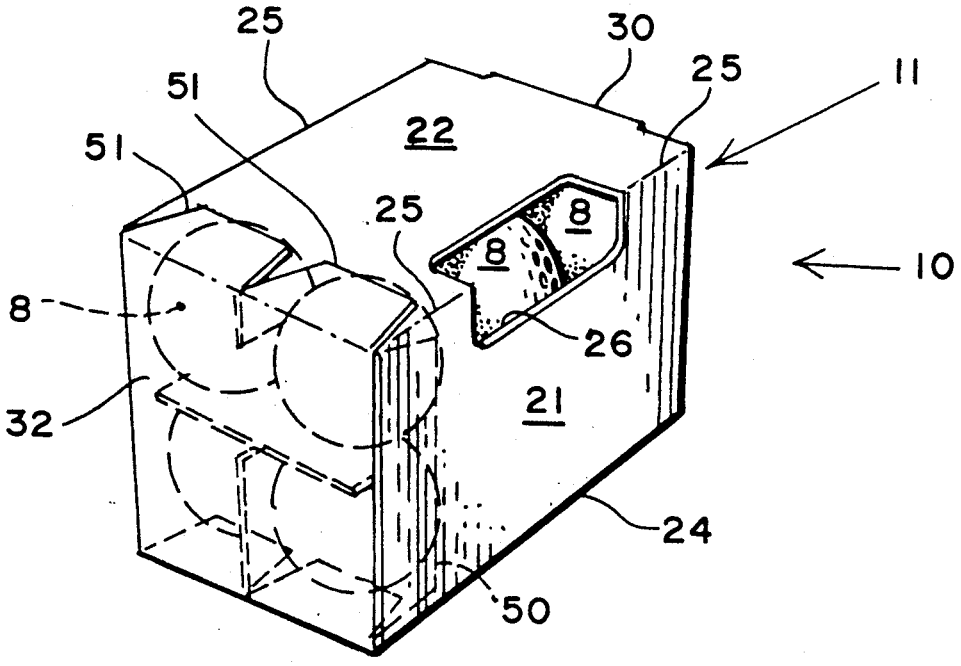
FIG. 16 is an alternative embodiment showing the top closure with hot melt on the tabs and omitting the use of the top cover 12.

In FIG. 16 the alternative embodiment closed lid construction is shown where the sleeve cover 32 has exterior tabs which are hot melt secured to the tube sides 21 and 22 as a construction alternative to that shown in FIG. 5.

Figure 4:
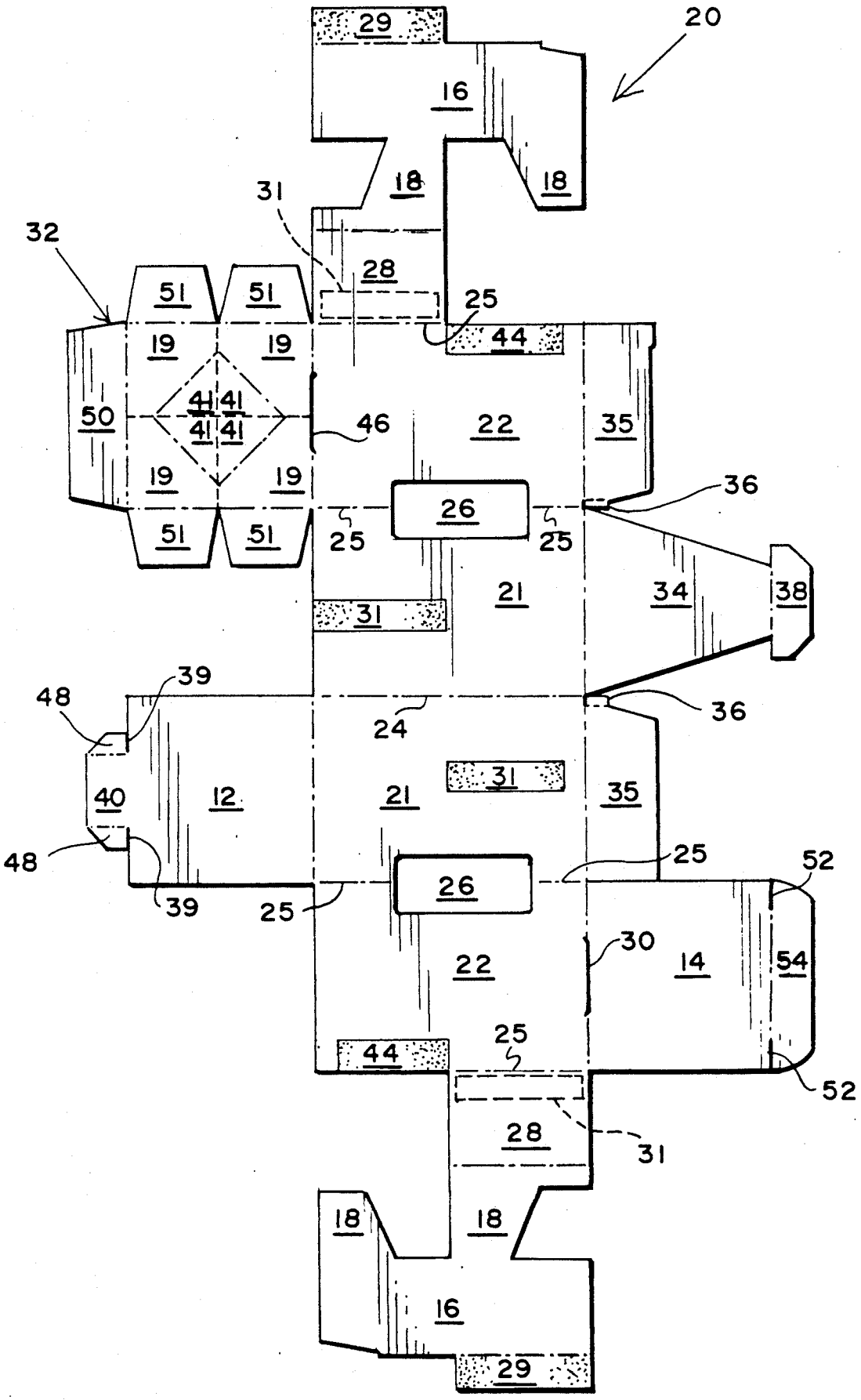
FIG. 4 is an enlarged fold out view of the carton blank illustrative of the present invention.

As shown in FIG. 4, the carton blank 20 is elongate in nature. The four principle elements are the four tube sides which are made up of the tube side center members 21 which meet at a single adjacent fold line 24, and remote from the two tube side center members 21 are the remote tube sides 22. Where the remote tube sides 22 join the center tube sides 21 provision is made at the fold lines 25 for windows 26 which go on either side of the intersections.

Extending from the remote edges of the remote tube sides 22 are the strut assemblies on either side. The strut assemblies are joined to the remote tube sides 22 by means of anchors 28. Beyond the anchors 28 are the anchored partial struts 18, and beyond it are the anchored full struts 16. The unsupported partial struts 18 extend from the anchored full struts 16. At the far remote edges provision is made for glue flaps 29. These two glue flaps when folded centrally along the fold lines 25 between the anchors 28 and the remote tube sides 22 hit target areas 31 which are central of the adjacent center tube sides 21.

It will be seen that a sleeve cover 32 extends from the underneath portion of remote tube side 22, and a bottom panel 14 extends from an opposite remote tube side 22. A bottom lock 34 extends from the tube side center 21, and opposed to it the top cover 12 extends from tube side center 21. T:;o bottom dust flaps 35 having end pie lock shoulders 36 flank the bottom lock 34. The bottom lock 34 at its far end has a bottom lock locking tab 38. The top 12 has underneath cuts 39 and a top lock tab 40. The sleeve cover 32 has a set of four stack lids 19 which are separated from each other by perforated lines. Central of the sleeve cover 32 are four opening tabs 41 in a diamond shaped orientation which can be depressed in order to peel back the stack lids 19 to open up one of the internal tubular sections 15 for the removal of the contents.

Figure 6:
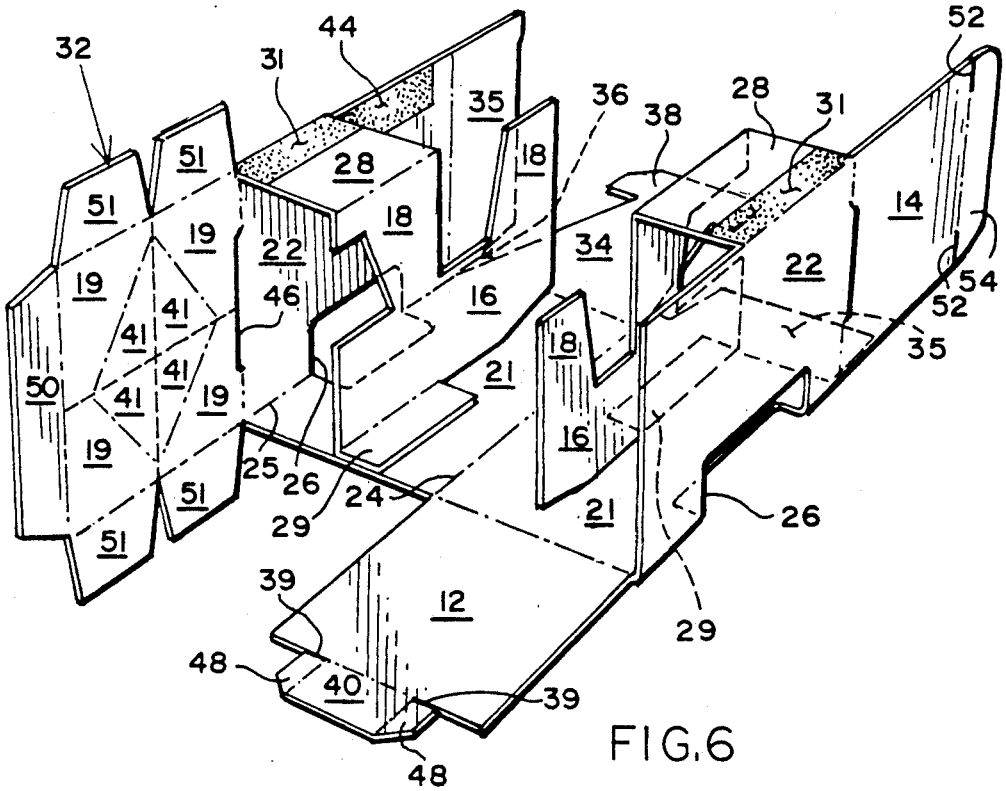
FIG. 6 is sequential to that of FIG. 5 showing again in perspective the configuration of the illustrative carton after the first glue step has been completed.
Figure 7:
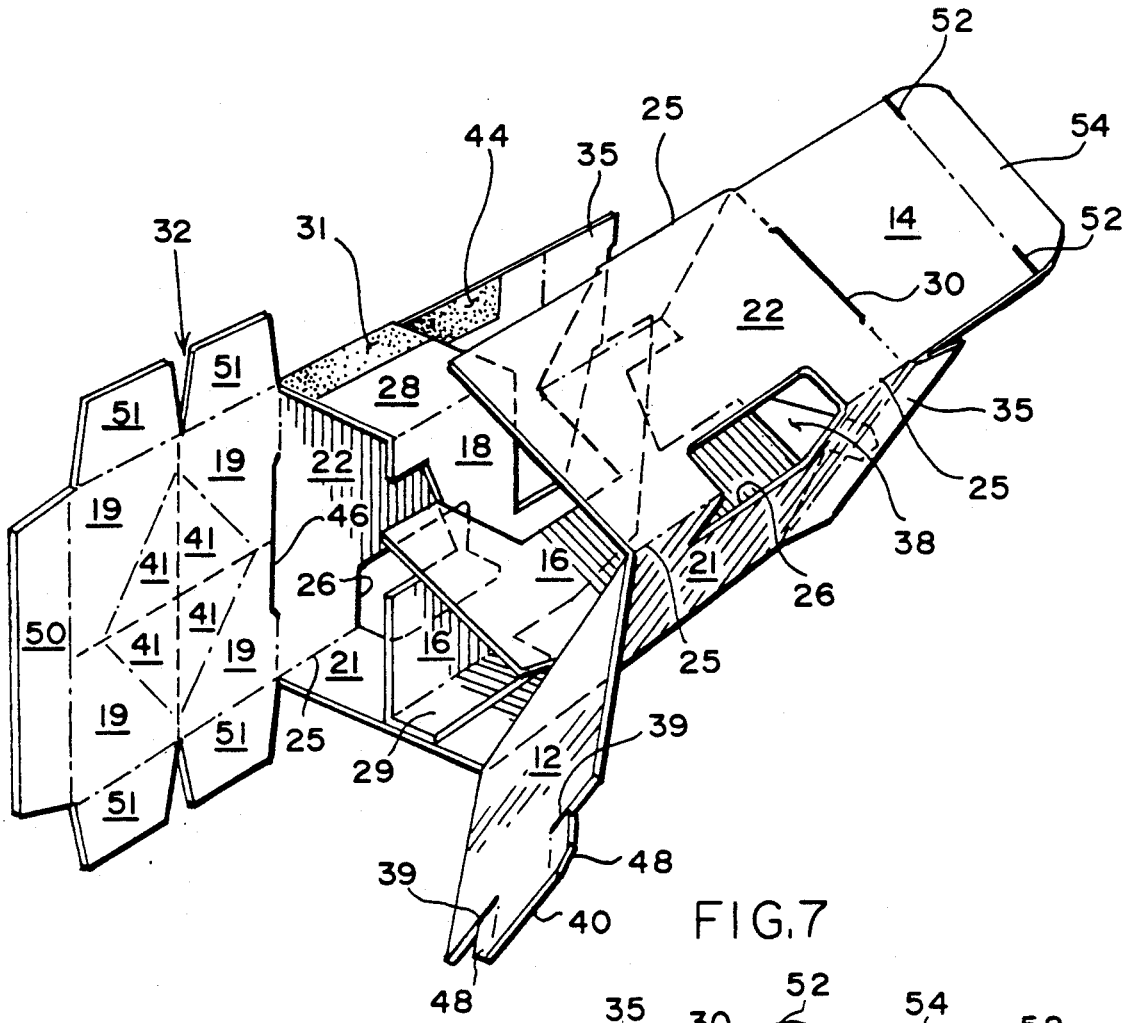
FIG. 7 is again a sequential view showing the fold necessary to accomplish the final gluing and closure of the carton.
Figure 8:
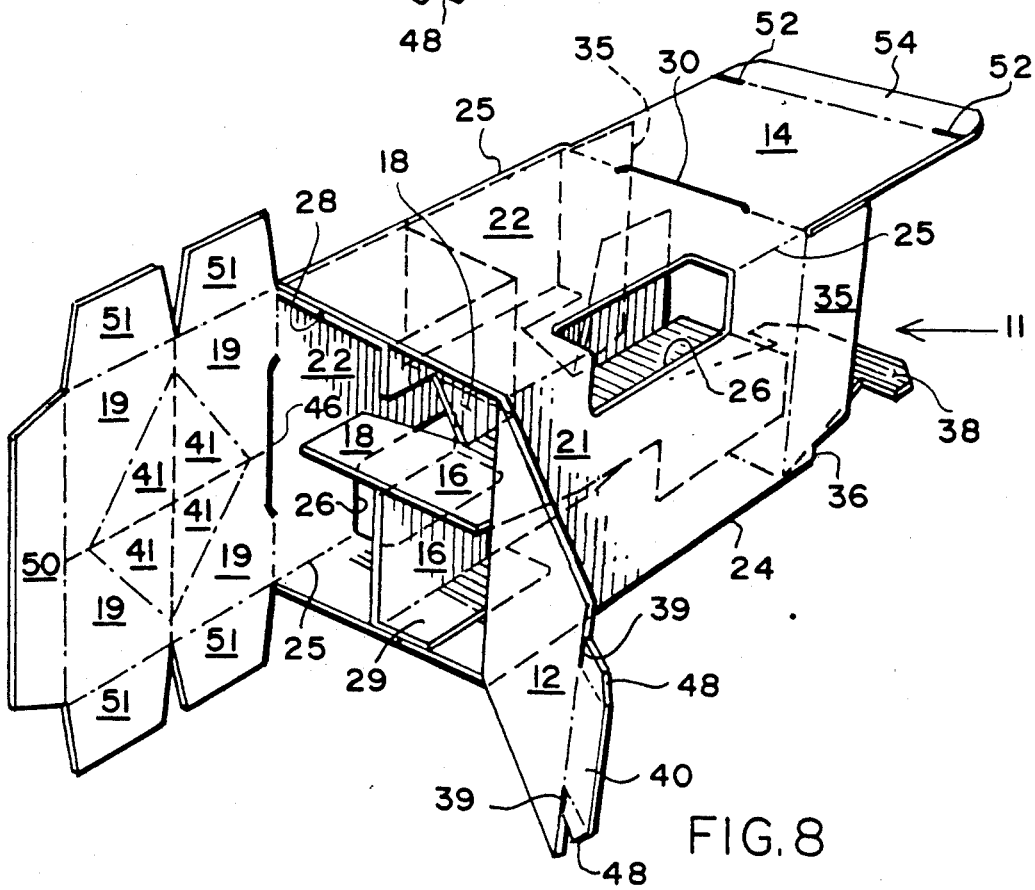
FIG. 8 is a perspective partially diagrammatic view illustrating the carton with the bottom and top open ready for closure.

At the time of assembling the carton blank 20 into the display carton 10, as shown in FIG. 5, the two remote glue flaps 29 have glue applied to them and then are folded centrally and the glue flaps hit their respective targets 31 on the interior portion of the center tube sides 21. After gluing, the configuration is essentially as shown in FIG. 6. Thereafter a Mactron shot 44 is applied to one edge or the other of the already first folded carton, and the carton is then folded along the center line 24 formed by the adjacent center tube sides 21 and the carton is completed. To erect the carton it is compressed on the opposed edges. The first opening configuration is shown in FIG. 8.

Figure 9:
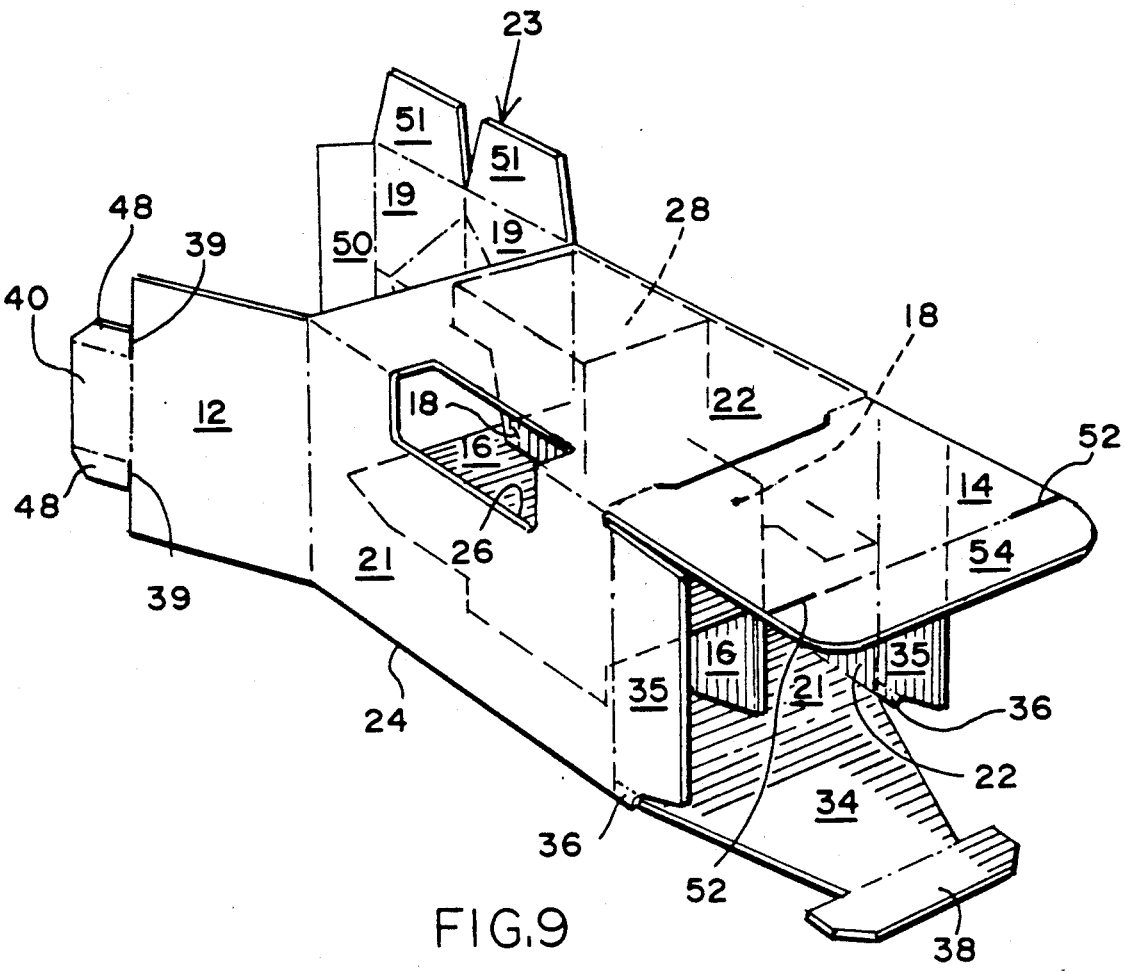
FIG. 9 is a view illustrating the configuration of the bottom ready for closing.
Figure 10:
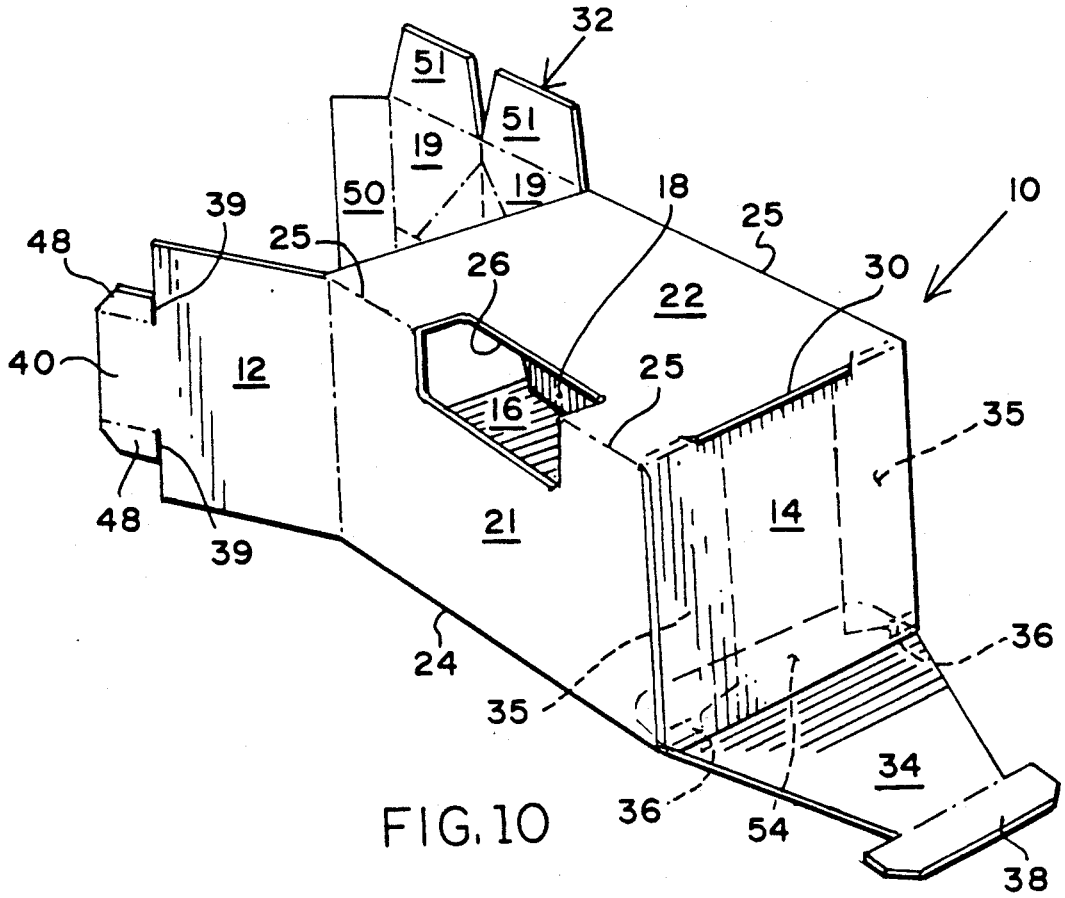
FIG. 10 is a sequential view to FIG. 9 showing the bottom cover tucked in place awaiting locking with the locking tab.
Figure 11:
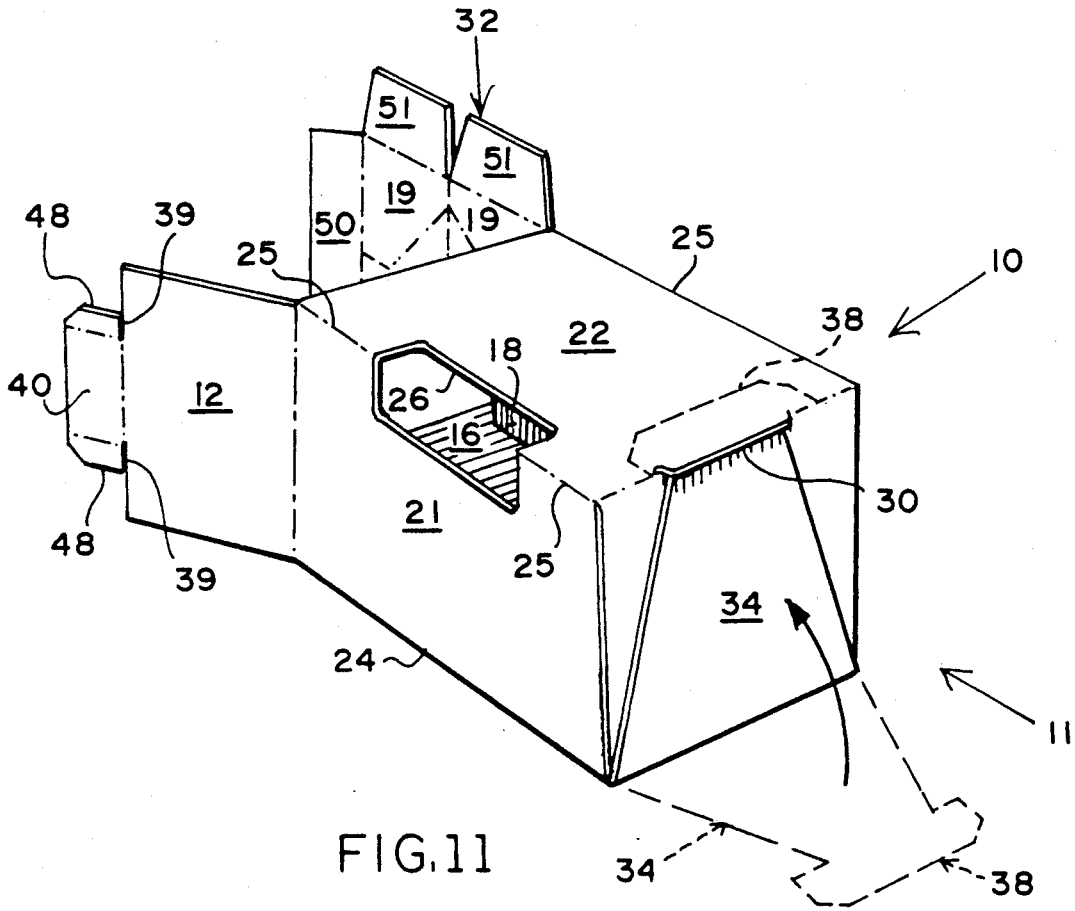
FIG. 11 shows the locking tab diagrammatically rotated into locked position to complete the bottom.

The bottom is closed as sequenced in FIGS. 9, 10 and 11 by first closing the dust flaps, thereafter the bottom panel, and finally the bottom lock 34. The tab 38 of the bottom lock 34 is secured in slot 49.

Figure 12:
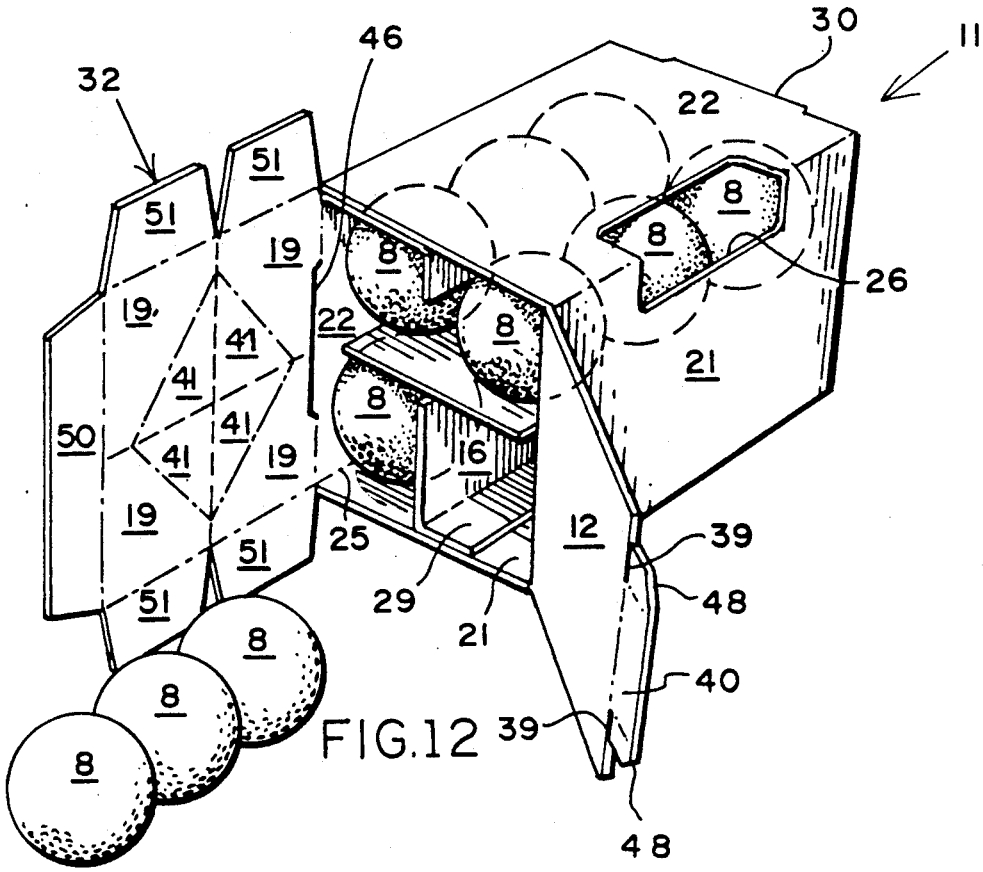
FIG. 12 shows the loading of the carton with golf balls in each one of the tubular members.
Figure 14:
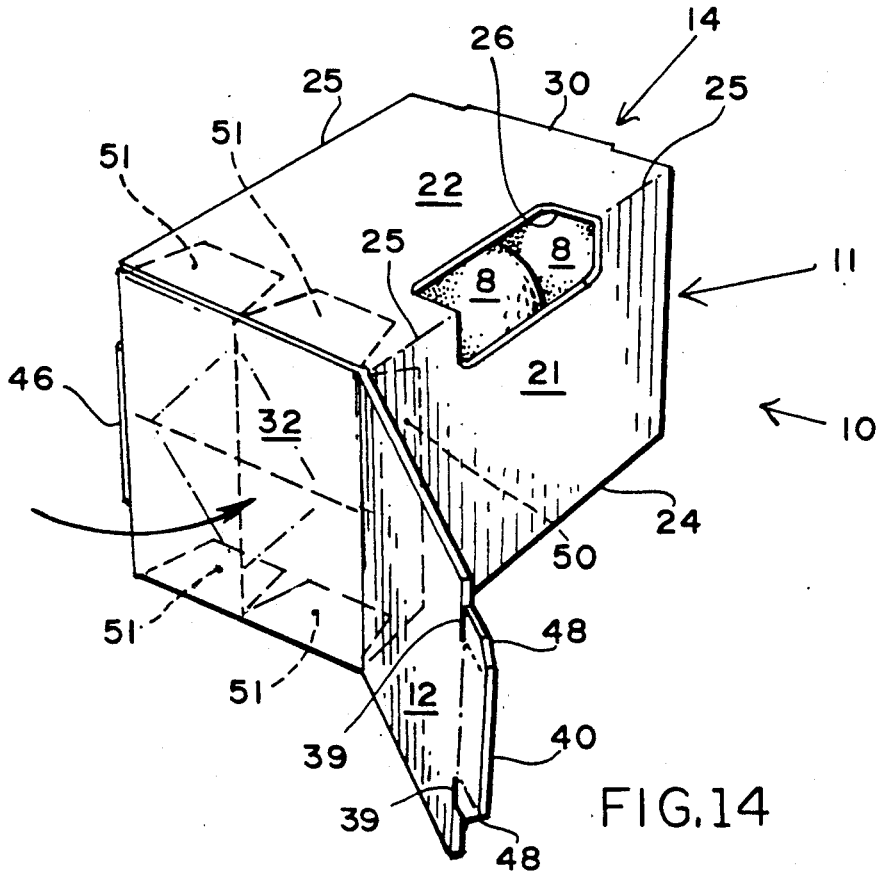
FIG. 14 shows the first portion of the top being closed awaiting the final lock.
Figure 15:
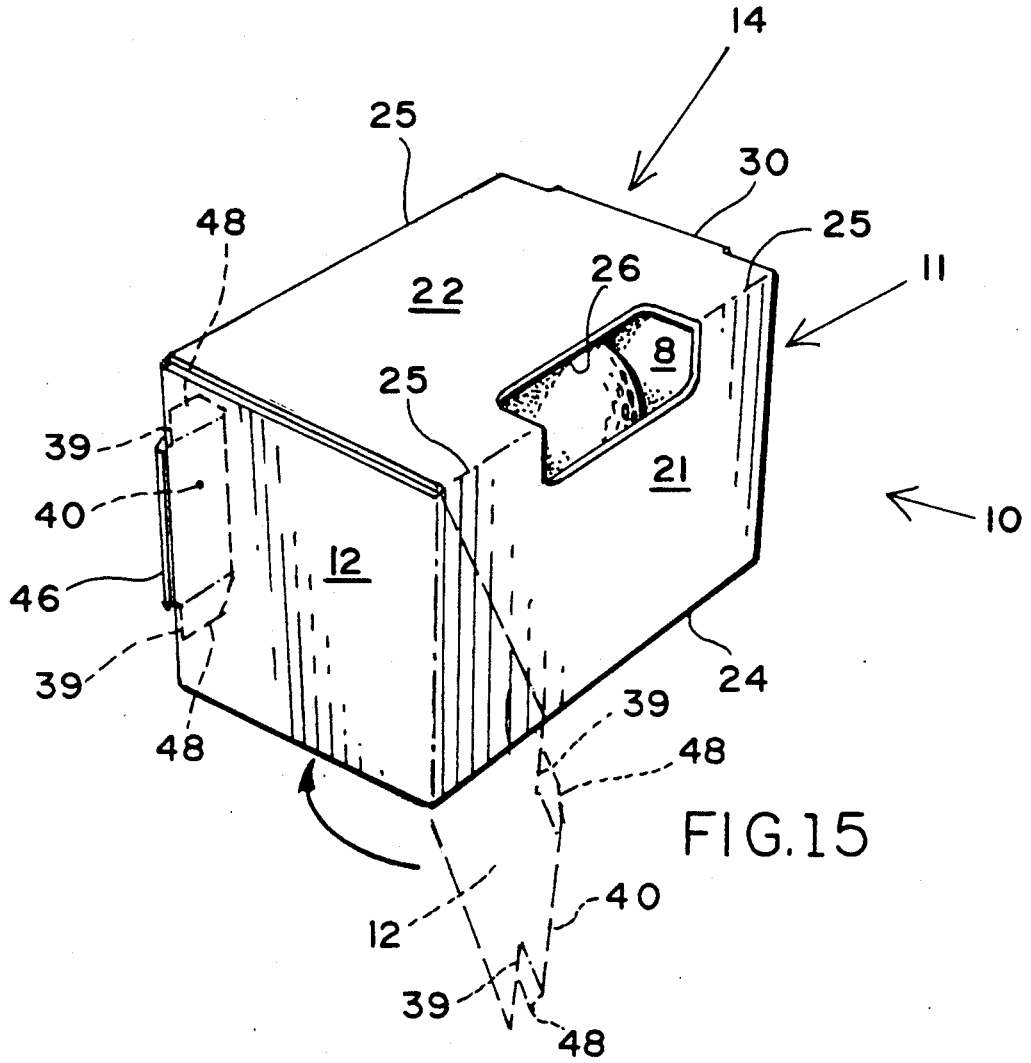
FIG. 15 is sequential to FIG. 14 showing the top lock diagrammatically rotated into place.

The top closure is positioned as shown in FIG. 12 where first the balls 8 are inserted, and then the sleeve cover 32 is closed partially as shown in FIG. 13 where the tabs 51 are ready to fit into the tubular portions 15, followed by full closure as shown in FIG. 14 awaiting the final securement by the lid 12 as shown in FIG. 15.

The alternative embodiment shown in FIG. 16 eliminates the top closure, and just has the single closure with the four tabs 51 hot melted to the sides 21 and 22 of the carton.

A typical layout die is used for forming six of the carton blanks 20 from a single sheet of paper. In a typical commercial embodiment, such a sheet of paper is approximately fifty and one-eighth inches long, and thirty-five and one-half inches wide.

While dimensions are not critical to the present invention, in a typical commercial embodiment the tube side elements 21 and 22 are five inches long, and three and three-eighths inches wide. The sleeve cover 32 is approximately three and eleven thirty-seconds by three and three-eighths inches having its sleeve cover main tuck flap 50 extending from one and one-thirty second inches, with ten degree angled sides.

The main anchors 28 are each one and eleven-sixteenths inches long, and two and three-eighths inches wide. The uninterrupted strut is one and eleven-sixteenths inches wide, and five inches long. The interrupted struts are one and five-sixteenths for the anchored interrupted strut, and one and three-sixteenths for the unsupported strut. The grain of the carton 10 normally is in the direction of left to right on the panel as just described, being perpendicular with the two remote end glue flaps 29.

The method of forming the carton 10 is primarily a function of the sequential gluing, as shown and described, the remote glue flaps 29 are normally glued at the same time, and then folded centrally along the anchor fold lines 25 at the edges of the remote tube sides 22. Thereafter, the Mactron shot 44 of glue is applied optionally to one or the other of the remote edges 45 after the first fold and glue has been made, and then the two members are folded relatively each to the other along the central fold line 24 between the central tube sides 21. This completes the formation of the carton.

In review, it will be seen that we have disclosed and described a stacking carton which while originally intended for stacking a dozen golf balls, has wider application in other packaging applications for spherical items such as ping pong balls and tennis balls, as well as stacking items such as badminton shuttle cocks and the like. The panel itself utilizes very efficiently and effectively a reduced amount of board as contrasted to the prior art. Furthermore, the panel lends itself to efficient nesting in a single sheet for cutting the same six up. The method of gluing and folding utilizes straight line gluing equipment and high production speeds are readily achieved.

Although particular embodiments of the invention have been shown and described in full here, there is no such limitation of embodiments. On the contrary, the intention is to cover all modifications, alternatives, embodiments, usages and equivalents as fall within the spirit and scope of the present invention, specification and appended claims.

What is claimed is:

1. A stacking carton for holding a plurality of members in four stacks, said carton having four internal tubular sections of a tube, said tube having opposed closed ends and four sidewalls, comprising, in combination, two anchored full panel struts adjacent each other and extending at an angle with respect to each other, anchor tabs each attached to one of said two full panel struts which run substantially the full length of each strut and are secured to a mid-portion of an adjacent sidewall, two partial panel struts attached to said full panel struts, each partial panel strut having a portion secured to one of said sidewalls and an unsecured portion, each portion being spaced from the other a distance to inhibit the lateral shifting of contents of the carton, and an anchor tab attached to each partial panel strut for securing the secured portion of each partial panel strut, said anchor tabs each being secured at a mid-position to an adjacent one of said sidewalls, whereby a single carton having four internal stacking sections can be formed in knock down configuration.

2. A locking bottom in combination with the carton of claim 1, said locking bottom having a bottom panel essentially rectangular terminating in a tuck flap, a slot in said bottom, and a bottom lock member having a remote tab for securing over the bottom.

3. In the stacking carton of claim 1, a sleeve cover, said sleeve cover being divided into four removable stack lids intersecting and defining intersection, and a plurality of opening tabs centrally disposed at the intersection of the four stack lids.

4. A blank for a folding carton which carton has a tubular body with four internal tubular sections, said blank comprising, four essentially rectangular sides, two of said tube sides being center tube sides and meeting at a mutual fold line, two of said tube sides being remote tube sides and extending respectively from each of the tube centers, and strut forming members secured by means of two anchors to the two remote tube sides, said strut forming members including:

an anchored full strut extending from each the anchored partial strut, an unsupported partial strut at an end of said anchored full strut remote from each the anchored partial strut, and a glue flap extending from the remote end of each said anchored full strut.

* * * * *